US006955400B2

(12) United States Patent
Bellvis Castillo

(10) Patent No.: US 6,955,400 B2
(45) Date of Patent: Oct. 18, 2005

(54) DYNAMIC FOOTREST

(76) Inventor: Juan Luis Bellvis Castillo, Sagrada Familia, 1, 50012 Zaragoza (ES)

( * ) Notice: Subject to any disclaimer, the term of this patent is extended or adjusted under 35 U.S.C. 154(b) by 0 days.

(21) Appl. No.: 10/095,414

(22) Filed: Mar. 11, 2002

(65) Prior Publication Data

US 2002/0096930 A1 Jul. 25, 2002

Related U.S. Application Data

(63) Continuation of application No. PCT/ES00/00280, filed on Jul. 27, 2000.

(30) Foreign Application Priority Data

Sep. 15, 1999 (ES) ..... 9902052

(51) Int. Cl.[7] ..... A47C 7/50; A47C 20/04

(52) U.S. Cl. ..... 297/423.26; 297/423.46; 297/423.3; 482/80; 601/31

(58) Field of Search ..... 297/423.26, 423.29, 297/423.3, 423.34, 423.35, 423.39, 423.4, 423.46; 482/80; 601/31

(56) References Cited

U.S. PATENT DOCUMENTS 3,858,938 A * 1/1975 Kristensson et al. ... 297/423.19
3,883,173 A * 5/1975 Shephard et al. ..... 297/201
3,917,261 A * 11/1975 Small et al. ..... 482/79 X
4,842,265 A * 6/1989 Kirk ..... 601/31 X

* cited by examiner

*Primary Examiner*—Anthony D. Barfield
(74) *Attorney, Agent, or Firm*—Klauber & Jackson

(57) ABSTRACT

The invention relates to a dynamic footrest, more particularly to a type of footrest which enables the user to rest his or her feet on said footrest with the purpose of helping him or her adopt a better posture, whereby the dynamic footrest (1) comprises a pair of adjacent and independent platforms (2) and (3) that are rotationally mounted relative to a common transversal axis (4), in addition to means for transmitting a rotational movement to one of the platforms and means for transmitting rotational movement from one platform to the other.

6 Claims, 2 Drawing Sheets

DYNAMIC FOOTREST

This is a continuation of PCT/ES00/00280 filed Jul. 27, 2000.

OBJECT OF THE INVENTION

The following invention comprises a dynamic footrest, being of the type of those used in numerous workstations, with the object of the worker being able to support the feet, thus allowing to take the most ergonomic possible posture; in such a way that the dynamic footrest comprises two independent platforms for supporting the feet, these being provided with own movement that is transmitted to the feet and legs of the user.

In this way, the platforms for supporting the feet transmit a moderate and imperceptible movement to the feet and legs of the user, in the way of physical exercise, that activates the circulation of the lower limbs, thus efficiently counteracting the unpleasant consequences of a sedentary activity.

Just as the conventional footrests are mainly intended for use at workstations, with the use of this footrest a beneficial effect is achieved and its use can be extended to a wider number of users as it clearly has advantages for the health.

The field of application comprises all those places in where, due to the particular professional or personal conditions, there are people who are obliged to remain for long periods of time in a sedentary position, such as sedentary workstations, long journeys, people who are immobilised in a wheel chair due to an illness or because they are affected by physical disabilities and also for certain works at home, all of which including an important part of the population in developed societies. Also, the footrest can be used during certain leisure activities, such as reading, watching on the television, etc.

BACKGROUND OF THE INVENTION

With the progress, the jobs to be carried out by humanity are becoming increasingly sedentary, a great deal of the working day taking place in a seated position, which is not exactly the most ergonomic posture for the human constitution.

Thus, the great majority of jobs at present are carried out in a seated position, even more so in the more developed countries, in which the hard nature of manual work has being progressively eliminated and more automated jobs are taking its place that need no physical effort to perform them.

Thus, it is known that sedentary postures are increasing enormously in developed societies, and the problems that these imply for the persons concerned are increasing in parallel with this.

Modern studies on ergonomics have demonstrated the need to equip with footrests those places where people normally work in a sedentary position for more or less prolonged periods of time.

The modern science of ergonomics dedicates a great deal of time to the study of this matter and, as a result of the work carried out, standards have already been published in this respect, that include prescriptions on the minimum performances with which the footrest has to comply.

On the other hand, conventional footrests existing on the market are static devices; although they comply with the necessary regulations on height and the angle of inclination of the platform for supporting the feet to adapt to the characteristics of each user, they do not have any movement of their own; they condemn the lower limbs to anti-natural immobility, immobility which in a short time is translated into discomfort for the person and, in the long term, to problems regarding circulation of the blood and others.

French Patent Application 2644994 describes a dynamic sitting active device with a movable footrest designed to move some parts of the body of a user such as, the lower extremities, pelvis, gluteal muscles, dorsal muscles and vertebral column by means of the displacement of the lower extremities of a user seated on a tilting seat.

DESCRIPTION OF THE INVENTION

In this description, a dynamic footrest is described with the object of solving the aforementioned problems, being of the type of footrest that is used as an independent piece of furniture, and preferably positioned underneath a desk, with the object of the user being able to support his feet on it, thus adopting a more ergonomic position; the dynamic footrest comprises a first platform and a second platform, said platforms being adjacent and independent from each other being mounted on a swivel with respect to a common transverse axle and with means for transmitting oscillating movement to the platforms.

The means for transmitting the oscillating movement to the platforms of the footrest are through a motor-reducer and a rod-crank, which transmits the movement from the driving shaft to the corresponding platform of the footrest, from which movement is transmitted to the platform adjacent to it.

The transmission of the oscillating movement to the platform which receives the movement from the motor-reducer to the adjacent platform is produced by a centrally or eccentrically articulated rocker arm, which transmits an inverse movement, that is to say, when one platform ascends the other descends and vice versa.

Likewise, the transmission of the oscillating movement of the platform that receives the movement from the motor-reducer to the platform adjacent to it, is produced by an iron plate integral to both, obtaining a synchronous oscillating movement between both of them, acting in this way as it would for a single support platform for supporting the feet.

The means for transmitting the oscillating movement to the platforms of the footrest are defined through a motor-reducer and a pair of rod-crank elements, joined to the driving shaft and to the respective platforms, being able to transmit a synchronous or asynchronous movement.

The means for transmitting the oscillating movement to the platforms of the footrest are defined by slowing down electromagnets, that produce an oscillating movement with equal effect.

Likewise, the footrest can include a pair of motor-reducers each acting on the corresponding platform, although this embodiment is not the most practical for its economic cost.

On the other hand, the pair of adjacent and independent platforms, mounted on a swivel with respect to a common transverse axle, are appropriate to be used as the support element for the feet of people in wheel chairs which, with the inclusion of a driving system, transmit a continuous and imperceptible movement to the user's feet and legs, which is preferable for use by handicapped people.

To complement the description given below and with the object of a better comprehension of the characteristics of the invention, this description is accompanied by a set of drawings, in which illustrative but not limiting figures represent the most characteristic details of the invention.

DESCRIPTION OF AN EMBODIMENT OF THE INVENTION

Figure 1:
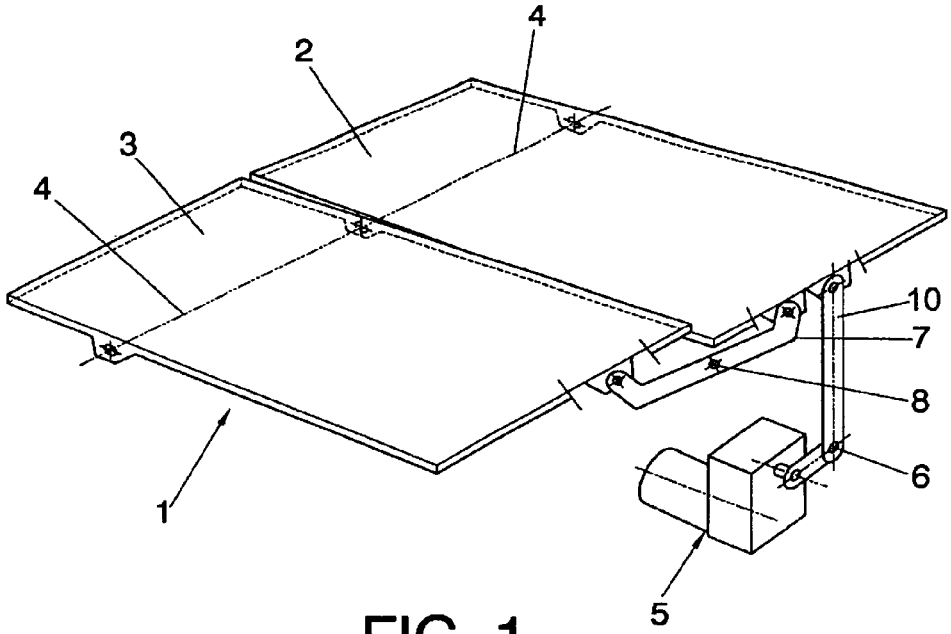
FIG. 1: Shows a view in perspective of the dynamic footrest and it can be seen that it has a support platform for each of the user's feet, both platforms swivelling with respect to the same axle of rotation and having a driving system to provide these platforms with movement.

In view of the figures commented above and according to the numbering system adopted, it can be seen that the dynamic footrest 1 comprises a first platform 2 and a second platform 3 being mounted on a swivel around the same axle 4, in such a way that the two platforms 2 and 3 provided with a vertical oscillating movement, are adjacent and independent, one for each feet of the user.

The two platforms 2 and 3 are able to move independently around their common axis 4.

These platforms are animated with a movement they receive from the driving system located in the rear inner part of the footrest.

In a practical execution of the invention, the driving system is composed of a motor-reducer 5 and the articulated transmitter system of the rod-crank 6, that transmits the movement to one of the footrest platforms, changes the swivel movement into a vertical oscillating movement. The movement of platform 2 that receives the movement from the motor-reducer 5, is transmitted to the second platform 3 by means of a forwarding lever or rocker arm 7, that is articulated by the axis 8, centrally or eccentrically.

In this way, platform 3 is joined to platform 2, via an articulated rocker arm 7 that turns with respect to an axle 8, in such a way that platform 2 transmits its own movement to platform 3 via the rocker arm 7, but with the movement inverted, that is to say, while platform 2 ascends, platform 3 is descends and vice versa.

The reciprocal movement of the two platforms 2 and 3 may be synchronous or asynchronous and the amplitude of its movements can be varied by conveniently displacing the centre of rotation 8 of articulated rocker arm 7.

Likewise, platforms 2 and 3 are able to move integrally by means of an iron plate, in such a way that the drive system will transmit the synchronous vertical oscillating movement to both platforms acting as if they were a single platform.

The transmitter system can be defined as a motor-reducer and two rod-crank transmission elements 6, connecting each one of these elements to the corresponding platform and being able to obtain a synchronous or asynchronous movement.

On the other hand, the vertical oscillating movement of the two platforms can be obtained by means of slowing down electromagnets or other means.

Equally, the footrest may include two motor-reducers that will transmit the oscillating movement independently to each of the platforms by means of the corresponding rod-crank element 6.

Depending on the position of the axle of rotation 4 of the platforms 2 and 3, various modes or types of movement can be achieved for them, independently of the frequency and amplitude of the movements generated by the driving system.

Figure 2:
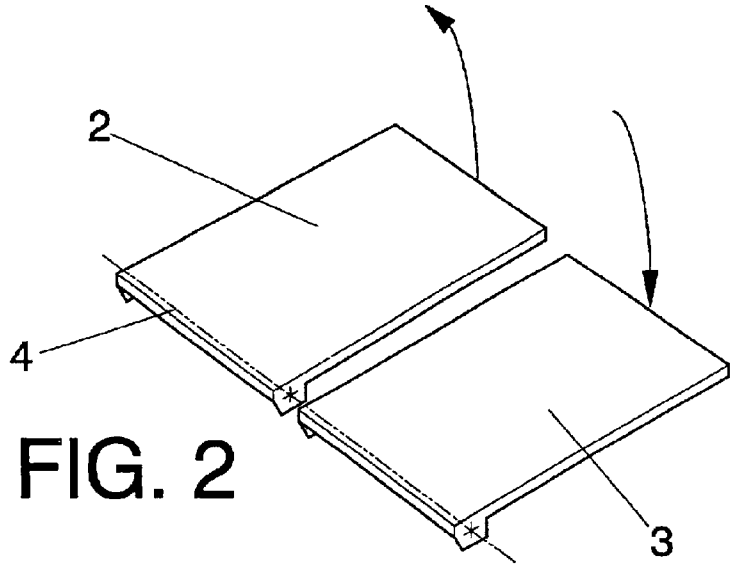
FIG. 2: Shows a view in perspective of a pair of support platforms for the feet relative to the dynamic footrest, in whose practical execution the axle of rotation is positioned with respect to the front part of them.

Thus, in FIG. 2 of the designs, the axle of rotation is found in relation to the front part of platforms 2 and 3, in such a way that in this practical execution no movement exists in the area corresponding to the heel of the user's foot and, on the contrary, the maximum movement is found in the rear end of platforms 2 and 3, that is to say, with regard to the end of the user's foot.

Figure 3:
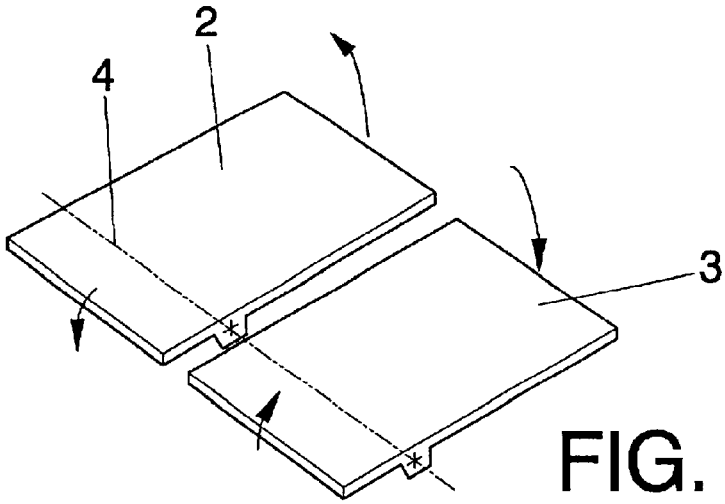
FIG. 3: Shows a view in perspective of a pair of support platforms for the user's feet, as a variant of practical execution, in which case the axle of rotation of them is slightly displaced towards the interior of both platforms.

FIG. 3 of the designs shows how the common axle of rotation 4 of platforms 2 and 3 has been displaced to some degree towards the centre of the platforms and, in this practical execution, the user's foot receives a certain amount of movement in the heel which will depend on the degree of this displacement.

Figure 4:
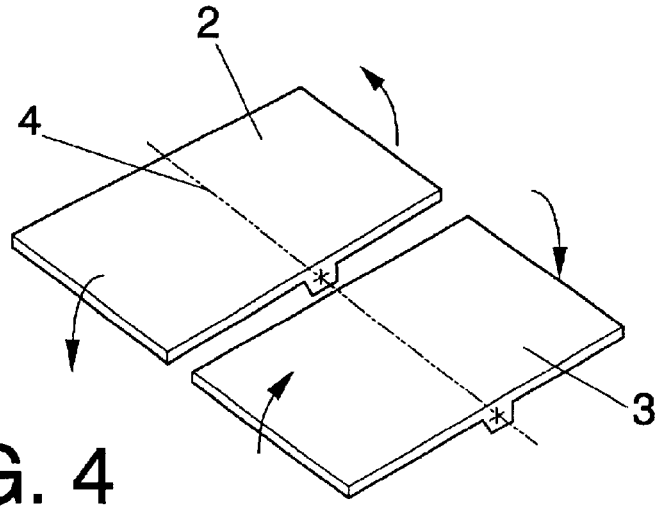
FIG. 4: Shows a view in perspective of a pair of support platforms for the user's feet, as a variant of practical execution, in which case the axle of rotation of them is positioned with regard to the transverse central axle of the platforms.

Finally, FIG. 4 of the designs shows how the common turning axle of rotation 4, for platforms 2 and 3 is located with regard to the transverse axle of platforms 2 and 3, which corresponds to movements of the same magnitude, both for the heel and for the end of the user's foot.

Thus, by the way in which the dynamic footrest described has been executed, the product is shown to have great versatility as this allows the footrest to be manufactured to adapt to various requirements according to the needs of the collectives that require to use it.

The amplitude and frequency of movement of the support platforms for the feet can be fixed at an infinity of values but, in practice, the recommended parameters are restricted by ergo-therapists and physiotherapists with the object of achieving optimum results for the user.

In this particular case, the amplitude of the movement of platforms 2 and 3 will be given by the dimension of the connecting rod of the articulated system, and the frequency by the turning speed of rotation at the output of the motor-reducer 5.

The movement of the platforms transmits a moderate and imperceptible passive physical exercise to the feet and legs of the user that activates the circulation in the lower limbs, efficiently counteracting the unpleasant consequences that are the result of a sedentary activity.

Logically, the driving system and the support platforms for the feet will be mounted in the corresponding housing, forming an independent element that will be able to be used wherever the user wishes to do so.

Likewise, the support platforms for the feet can become the footrests on wheelchairs, since as they include a drive system, they will let to transmit a small and imperceptible movement to the user's feet and legs.

What is claimed is:

1. A dynamic footrest for use in improving posture, wherein the dynamic footrest comprises a first platform for supporting a first foot of a sitting user and a second platform for supporting a second foot of said user, each platform having a front portion, a rear portion, an inner side and an outer side, said platforms being independent from each other;

motor-driven means for transmitting an oscillating movement located on a plane transversal to the platforms, said plane being located at the front portions of the platforms, each of said platforms being mounted on a swivel on a common transverse axis which extends through the respective portions of the platforms and is distanced from the front portions of the platforms; and the inner sides of the platforms being adjacent with each other.

2. A dynamic footrest according to claim 1, wherein the means for transmitting an oscillating movement to the platforms is defined by a motor-reducer and an eccentric-rod joined to a driving shaft and to the first platform, from which movement is transmitted to the second adjoining platform.

3. A dynamic footrest according to any of the claims 1 and 2, wherein the transmission of the oscillating movement from the first platform to the second platform is produced by a centrally or eccentrically articulated rocker arm that transmits an inverse movement.

4. A dynamic footrest according to any of claims 1 and 2, wherein the transmission of the oscillating movement for the first platform to the second platform is produced by a plate that is integral to both.

5. A dynamic footrest according to claim 1, where the means for transmitting an oscillating movement to the platforms comprises a motor-reducer comprising a driving shaft;

a pair of eccentric-rod elements joined to the driving shaft, and each of said eccentric-rod elements being connected to one of the respective platforms, for transmitting a synchronous or asynchronous oscillating movement to the platforms.

6. A use of the dynamic footrest according to claim 1, wherein the platforms are the support elements for feet in a wheel chair, thus transmitting continuous and imperceptible movement to the user's feet and legs.

* * * * *